United States Patent [19]

Kaukeinen et al.

[11] 4,234,670

[45] Nov. 18, 1980

[54] REDUCIBLE METAL SALT-DRY ELECTROGRAPHIC VISIBLE IMAGE RECORDING PROCESS

[75] Inventors: Joseph Y. Kaukeinen; Duane A. Rockafellow, both of Rochester, N.Y.

[73] Assignee: Eastman Kodak Company, Rochester, N.Y.

[21] Appl. No.: 79,642

[22] Filed: Sep. 27, 1979

Related U.S. Application Data

[63] Continuation-in-part of Ser. No. 624,815, Oct. 22, 1975, abandoned, which is a continuation-in-part of Ser. No. 492,814, Jul. 29, 1974, abandoned.

[51] Int. Cl.[3] ..... G03G 13/22; G03G 13/24; G03G 13/12

[52] U.S. Cl. ..... 430/52; 430/55; 430/353; 430/45; 430/417; 430/69; 430/502; 430/524; 430/618; 430/619; 430/620; 204/2; 204/18.1

[58] Field of Search ..... 204/2, 18.1; 430/31, 430/55, 417, 353, 45, 52

[56] References Cited

U.S. PATENT DOCUMENTS

| | | | |
|---|---|---|---|
| 3,425,916 | 2/1969 | Tokamoto et al. | 204/18 |
| 4,188,212 | 2/1980 | Fujiwara et al. | 430/353 X |
| 4,188,226 | 2/1980 | Akashi et al. | 430/620 |

FOREIGN PATENT DOCUMENTS 1275929 6/1972 United Kingdom .

OTHER PUBLICATIONS

Lion et al., Investigation in the Field of Image Intensification, Jan. 31, 1964, U.S. Air Force, Cambridge Res. Labs. AFCRL-64-133.

*Primary Examiner*—John D. Welsh
*Attorney, Agent, or Firm*—D. I. Hague

[57] ABSTRACT

A method for producing visible images in certain charge sensitive, dry processable recording elements. Image recording is accomplished by flowing, in a resistive recording element containing a reducible metal compound, an imagewise pattern of electrical current of sufficient magnitude to produce therein a storable latent image. The metal compound in the latent image areas is subsequently reduced by a dry development technique to produce a visible image.

26 Claims, 9 Drawing Figures

HEAT-DEVELOPABLE LATENT IMAGE-FORMATION

HEAT-DEVELOPMENT

HEAT-DEVELOPABLE LATENT IMAGE-FORMATION

HEAT-DEVELOPMENT

REDUCIBLE METAL SALT-DRY ELECTROGRAPHIC VISIBLE IMAGE RECORDING PROCESS

CROSS-REFERENCE TO RELATED APPLICATIONS

Reference is made to commonly assigned U.S. Patent Application Ser. No. 624,815 entitled ELECTROGRAPHIC RECORDING PROCESS AND APPARATUS, filed on Oct. 22, 1975 in the names of Joseph Y. Kaukeinen and Duane A. Rockafellow of which the present application is a continuation-in-part and to U.S. Patent Application Ser. No. 492,814 entitled ELECTROGRAPHIC RECORDING PROCESS AND APPARATUS, filed on July 29, 1974, in the names of Joseph Y. Kaukeinen and Duane A. Rockafellow, both now abandoned.

BACKGROUND OF THE INVENTION

The invention relates to image recording and, more particularly, to a novel image recording process and apparatus wherein latent images are formed in certain metal-salt-containing recording elements by flowing a small imagewise pattern of electrical current therein and then heat processing the recording element to produce a visual image.

In recent years, a large research effort has been directed toward the development of new, as well as the improvement of old, image recording processes. The better known and commercially more successful of these recording processes can be broadly classified as being photographic, thermographic or electrographic or, as being a combination of two or more of these techniques, for example photothermographic. The terms photographic, thermographic and electrographic as used herein refer to recording processes in which the phenomena of light, heat and electricity, respectively, are used for the purpose of recording and reproducing patterns in viewable form. Each of the known image recording processes has its own advantages in particular applications but suffers from disadvantages which limit its usefulness in other applications. For example, conventional photography has the disadvantage of requiring chemical development procedures, thermography requires an imagewise heating procedure, and xerography, one form of electrography, requires a mechanical dust pattern transfer procedure.

It is known that images can be formed in certain recording materials by passing an electrical current therethrough and considerable effort has been expended in investigating this electrogaphic image recording technique. For instance, K. S. Lion et al in a report entitled "Investigation in the Field of Image Intensification, Final Report," in Air Force Cambridge Research Laboratories AFCRL 64-133, Jan. 31, 1964, Contract No. AF 19(605)-5704 disclose an electrographic process in which the recording element comprises a conventional light-sensitive photographic emulsion which is positioned adjacent to a photoconductive layer. Upon applying a uniform electric field across the photoconductive and photographic layers and simultaneously imagewise exposing the photoconductive layer to a light pattern, an imagewise current is produced in the photographic layer. This imagewise current flow, in turn, produces a chemically developable latent image in the photographic layer, which is more intense for a given light exposure than an image produced by imagewise exposing the photographic layer directly. The amplification is particularly pronounced when the incident light is of a color to which the photoconductor is responsive, but to which the photographic emulsion is not responsive.

While the Lion et al. recording technique presumably offers advantages in the form of increased sensitivity, it suffers the disadvantages associated with the use of a light sensitive, chemically developable recording layer. Moreover, the production of a latent image in a conventional light sensitive photographic emulsion requires a substantial current flow in the emulsion; hence, a relatively lengthy exposure time with low current flow or a high current flow with a short exposure time is required.

Another approach to the production of visible images is disclosed in U.S. Pat. No. 3,138,547 issued in the name of B. L. Clark. This approach involves the use of a light-insensitive, electrosensitive recording layer composed of particles of a reducible metal compound capable of electrical reduction in situ. The recording layer is disposed on an electrically conductive backing, and recording is effected by contacting the layer with an electrically charged stylus, thereby causing a current to flow through the layer. This current is sufficient to reduce the particulate metal compound, in the dry state, to provide a visible image.

A drawback of the recording process disclosed by Clark is that it incorporates no gain or amplification. For each reduction event leading to an increase in density of the final image, an additional quantity of electronic charge flowing through the recording element must be provided. Thus, relatively high current densities must be provided in order to produce a visible image in a reasonable period of time.

Still another recording technique is disclosed in U.S. Pat. Nos. 2,798,959 and 2,798,960 issued July 9, 1957 in the name of A. J. Moncrieff-Yeates. In accordance with the teachings of these references, a photoconductive material and a heat sensitive material are interposed between and in electrical contact with a pair of electrodes. An optical image is projected on the photoconductive material while a voltage is applied across the electrodes. The flow of electric current heats the photoconductive material, the heating effect in each increment of area being a function of the amount of current flowing, the resistivity of the photoconductive material and the intensity of the illumination. The heat image thus produced in the photoconductive material changes the heat sensitive material to form a permanent image therein.

One disadvantage of the Moncrieff-Yeates recording process is that high current flows are required in the photoconductive material in order to produce sufficient quantities of thermal energy for image formation. Furthermore, this recording process, in common with the Clark process requires an incremental increase in current flow for each incremental increase in density of the final image.

An image recording process which incorporates gain is disclosed by Tokumoto et al. in U.S. Pat. No. 3,425,916. According to this process, chemically-developable nuclei are formed in a reagent layer by imagewise exposing the layer to a relatively minute current flow. Unlike direct print-out image recording processes, such as mentioned above, the current flow itself need not be sufficient to produce a visible reaction in the reagent layer in situ. Rather, it need only be sufficient to produce nuclei which, during a subsequent chemical development step, can be amplified to produce a visible image.

While the aforementioned Tokumoto et al. process requires relatively low current flow to produce a developable latent image, the overall process requires that the recording material be moistened during the latent image or nuclei forming step. Moreover, the recording element on which the nuclei forming process is carried out requires chemical liquid development in order to intensify and thereby render visible the current produced nuclei. Furthermore, once developed, the visible image must be stabilized by washing and fixing, as in ordinary photographic processes. For these and other reasons, this process has not, to date, enjoyed substantial commercial use.

Another electrographic image recording process which incorporates gain is disclosed by Tokumoto et al. in United Kingdom Pat. No. 1,275,929. In this process, a latent image is formed by applying an imagewise electric current to a dry and conductive recording sheet formed of a conductive powder and an image forming component in a binder. The recording sheet is then heated in the presence of a redox system which includes a compound including at least one metal selected from nickel, cobalt, zinc, chromium, tin and copper to produce a visible image with the image forming component.

One disadvantage of this process is that it requires relatively large current flows (i.e., $\leqq 1$ milliampere/cm$^2$) through the conductive recording sheet for short times. Consequently the production of relatively high charge density levels (i.e., $\leqq 1$ millicoulomb/cm$^2$), are required for latent image formation. In certain electrographic image recording applications, the use of a conductive recording material and/or the production therein of a charge density of 1 millicoulomb/cm$^2$ or greater is either impossible or undesirable within a commercially practical exposure period. One example is the use of electrosensitive recording materials with sources of activating electrical energy, such as corona discharge devices or electrostatically charged devices, that do not develop a high electron current and cannot, therefore, produce a high charge density level in a short exposure period. Another example is the use of electrosensitive recording materials to detect electromagnetic radiation by sandwiching such a recording material with an electrophotographic photoconductor. To produce an imagewise current flow through the recording material, the resistivities of the photoconductor and the recording element must be matched within a predetermined range. Presently existing electrophotographic photoconductors are high impedance, low current devices. Therefore, if the recording material is highly conductive relative to the photoconductor a high current flow will be produced in the sandwich resulting in photoconductor breakdown, which breakdown in turn prohibits the formation of a latent image. One proposed use of an electrophotographicphotoconductor-electrosensitive recording material sandwich is medical radiography. In this application it is desirable to subject the patient to as small a dosage of X-ray radiation as possible. The recording material, therefore, must be capable of forming a latent image with the low charge density produced therein by the brief X-ray exposure of the high impedance, low current output photoconductor.

SUMMARY OF THE INVENTION

It is, therefore, an object of the invention to eliminate the aforementioned drawbacks of the prior art by providing an electrographic recording process wherein a latent image is formed in certain resistive, charge-sensitive, dry-processable recording layers by passing a relatively minute amount of electrical charge through the layer in an image-wise pattern and then amplified by uniformly heating the entire recording element to produce a visible image.

The term "charge sensitive recording material" as used herein, denotes a material which, when subjected to an electrical current, undergoes a chemical and/or electrical change which forms a latent image. The term "latent image" as used herein, denotes an invisible or faintly visible image which is capable of amplification in a subsequent heat development process.

The term "resistive recording material" as used herein denotes a material which has an ohmic resistivity of at least about $1\times10^{10}$ ohm-centimeter.

The process of the present invention has many advantages over prior art image recording systems.

Since the charge exposure necessary for latent image formation is several orders of magnitude less than that required by prior art dry electrographic image recording processes, lower levels of charge density can be detected and recorded.

The inventive process is versatile as well as simple. For example, a variety of devices can be used to regulate the current flow in the recording material including an electrostatically charged stencil, stylus or screen or a suitable photoconductive layer adjacent the image forming layer of the charge sensitive material. Furthermore, any source of radiation to which the photoconductor is responsive may be used as the exposure source, provided that the dynamic resistance of the photoconductor closely matches the dynamic resistance of the recording material in the operating voltage range of the invention.

Another advantage is that radiographic images produced in the resistive charge sensitive materials useful in the practice of the present invention have increased resolution over radiographic images produced with fluorescent phosphors.

The invention and its objects and advantages will become more apparent by referring to the accompanying drawings and to the ensuing detailed description of the preferred embodiment which follows.

DETAILED DESCRIPTION OF THE PREFERRED EMBODIMENTS

Figure 1A:
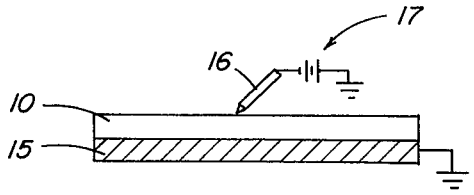
FIGS. 1*a* and 1*b* illustrate schematically an image recording process according to one illustrative embodiment of the invention.

Initially, it should be noted that although the present invention can be practiced in the manner subsequently described, the mechanism by which the latent image is formed in the recording material is not presently understood. Various hypotheses have been formulated regarding the formation of these latent images. According to one hypothesis, the injection of an electron, due to the applied electric field, into a reducible metal ion source results in the formation of a developable image site. It is further believed that the development of the latent image is accomplished by a reaction in the recording material whereby metal from the metal ion source is deposited or otherwise provided on the latent image site.

A variety of image-recording materials are useful according to the described invention. The optimum image-recording material will depend upon such factors as the source of activating electrical energy used, the processing condition ranges, and the like.

A typical resistive, charge sensitive, dry developable recording material useful in the process of the invention comprises an electrically conductive support (or, alternatively, a support coated with a conducting layer), the support or conducting layer having thereon at least one resistive layer comprising an image-forming combination including (i) a reducible metal salt with (ii) a reducing agent for the reducible metal salt in (iii) a binder for the layer.

A variety of reducible metal salts are useful in the described charge sensitive materials. Typical metal salts are silver salts of organic acids, such as fatty acids, which are resistant to darkening upon illumination. An especially useful class of silver salts is the visible light insensitive silver salts of long-chain fatty acids which include, for example, silver behenate, silver stearate, silver oleate, silver laurate, silver hydroxystearate, silver caprate, silver myristate and silver palmitate. Silver salts can be employed which are not silver salts of long-chain fatty acids if desired. Also, combinations of silver salts of long-chain fatty acids with other silver salts can be employed. Useful silver salts which are not silver salts of long-chain fatty acids include, for example, silver benzoate, silver benzotriazole, silver terephthalate, silver phthalate, and the like. Silver salts of nitrogen-containing heterocyclic compounds and silver salts of thione group-containing compounds are examples of other silver salts which are useful. These include, for example, silver salts of 3-carboxymethyl-4-methyl-4-thiazoline-2-thione, 3-(2-carboxyethyl)-4-hydroxymethyl-4-thiazoline-2-thione, 3-(2-carboxyethyl)-benzothiazoline-2-thione, 3-(2-carboxyethyl)-4-methyl-4-thiazoline-2-thione, and combinations of these silver salts. Also included are the silver salt of benzotriazole, silver salts of nitrobenzotriazoles, silver salts of an alkyl-substituted benzotriazoles, (e.g., methylbenzotriazole, etc.), silver salt of a halogen-substituted benzotriazoles e.g., silver salts of bromobenzotriazoles, silver salts of chlorobenzotriazoles, etc., silver salts of amidosubstituted benzotriazoles e.g.,

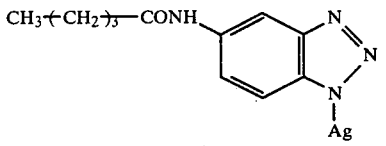

and

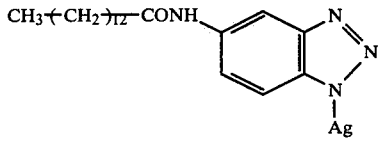

silver salt of benzimidazole, silver salts of a substituted benzimidazoles, e.g., silver salt of 5-chlorobenzimidazole, silver salt of 5-nitrobenzimidazole, etc., silver salt of dipicryl amine, silver salt of carbazole, silver salt of saccharin, silver salt of phthalazinone, silver salts of a substituted phthalazinones, silver salts of phthalimides, silver salt of pyrrolidone, silver salt of tetrazole, silver salt of imidazole, silver salt of an N-(benzoic acid-sulfonic acid-(B 2)-imide), (e.g., silver salt of N-(benzoic acid-sulfonic acid (2)-imide), silver salt of N-(4-nitrobenzoic acid-sulfonic acid-(2)-imide), silver salt of N-(5-nitrobenzoic acid-sulfonic acid-(2)-imide), etc., and the like.

Examples of useful metal salts which are not silver salts include nickel perchlorate, lead behenate, copper stearate, copper salt of benzotriazole and the like, Useful reducible metal salts are also described in U.S. Pat. No. 3,437,075 of Morgan et al. issued July 22, 1969; U.S. Pat. No. 3,152,904 of Sorensen et al. issued Oct. 13, 1964; U.S. Pat. No. 3,152,903 of Sorensen et al issued Oct. 13, 1964; U.S. Pat. No. 3,672,904 of deMauriae issued June 27, 1972; and U.S. Pat. No. 3,785,830 of Sullivan et al, issued Jan. 15, 1974 all incorporated herein by reference.

Visible light sensitive, reducible metal salts, which are also charge sensitive, can be used in lieu of, or in combination with, the previously described visible light insensitive metal salts. The charge sensitive materials can, for example, contain photosensitive salts, such as photosensitive silver salts including for example, photographic silver halide. Useful photographic silver halides include, for example, silver chloride, silver bromide, silver bromoiodide, silver chlorobromoiodide or mixtures thereof. For purposes of the invention, silver iodide is also useful and included within the scope of the term photographic silver halide. The photosensitive silver halide can be prepared in situ in the charge sensitive material by procedures as described, for example, in U.S. Pat. No. 3,457,075 and/or the photosensitive silver halide can be prepared separate from other components of the charge sensitive material and then mixed with the described other components at the desired time. The photosensitive silver halide can be a coarse or fine grain, very fine grain photosensitive silver halide being particularly useful. The photographic silver halide can be prepared by any of the well-known procedures employed in the photographic art, such as described in the above patent.

The potosensitive silver halide can be chemically sensitized, and can contain addenda commonly employed in photographic silver halide materials, such as sensitizing dyes, stabilizers, antifoggants, hardeners, coating aids and the like.

A variety of reducing agents for the reducible metal salts are useful in the described charge sensitive materials. Useful reducing agents include, for example, sulfonamidophenol reducing agents, as described in U.S. Pat. No. 3,801,321 of Evans et al, issued Apr. 2, 1974; polyhydroxybenzenes such as hydroquinone, alkyl substituted hydroquinones, such as tertiary butyl hydroquinone, methylhydroquinone, 2,5-dimethylhydroquinone and 2,6-dimethylhydroquinone; catechols and pyrogallols; aminophenol reducing agents, such as 2,4-diaminophenols and methylaminophenols; ascorbic acid reducing agents such as ascorbic acid and ascorbic acid derivatives; hydroxylamine reducing agents; 3-pyrazolidone reducing agents such as 1-phenyl-3-pyrazolidone and 4-methyl-4-hydroxymethyl-1-phenyl-3-pyrazolidone; and bis-beta-naphthols, such as described in U.S. Pat. No. 3,672,904 of deMauriac, issued June 27, 1972, and the like. Combinations of such reducing agents can be employed if desired.

A range of concentration of reducing agent can be employed in the described current sensitive materials. A useful concentration of reducing agent utilized with a reducible metal salt, such as silver behenate or silver stearate, is typically about 0.1 mole to about 10 moles of reducing agent per mole of reducible metal salt. When reducing agents are employed in combination, the total concentration of reducing agent is typically within the described concentration range. The most useful concentration of reducible salt in a particular charge sensitive material will depend upon several factors, such as the desired image, processing conditions and the like.

The described charge sensitive materials can include a variety of binders, especially polymeric binders, also known as vehicles. Useful polymeric binding agents are described in the previously mentioned patents describing useful reducible metal salts. These polymeric binders can be hydrophobic or hydrophilic. They include both naturally occurring substances such as proteins, for example, gelatin, gelatin derivatives, cellulose derivatives, polysaccharides such as dextran, gum arabic and the like; and synthetic polymeric substances such as water-soluble polyvinyl compounds like poly(vinylpyrrolidone), acrylamide polymers and the like. Other synthetic polymeric compounds which are useful include dispersed vinyl compounds such as in latex form and particularly those which increase dimensional stability of the current sensitive materials. Effective polymers include water insoluble polymers of alkyl acrylates and methacrylates, acrylic acid, sulfoalkylacrylates, methacrylates and those which have crosslinking sites which facilitate hardening or curing as well as those having recurring sulfobetaine units as described in Canadian Pat. No. 774,054. Especially useful polymers include polycarbonate, poly(vinyl butyral), cellulose acetate butyrate, poly(methylmethacrylate), poly(vinylpyrrolidone), ethyl cellulose, polystyrene, polyvinyl chloride, chlorinated rubber, polyisobutylene, butadiene-styrene copolymers, vinyl chloride-vinyl acetate copolymers, copolymers of vinyl acetate, vinyl chloride and maleic acid and poly(vinyl alcohol). Choice of an optimum polymer as a binder for the described charge sensitive materials will depend upon the particular reducible metal salt, the particular reducing agent, processing conditions, and the like. When the charge sensitive recording material is to be used with a photoconductor, selection of an appropriate polymeric binder can be useful in obtaining the desired impedance match between the recording material and the photoconductor. It is essential, however, that the binder selected does not adversely affect the desired properties of the charge sensitive material.

The charge sensitive layer of a recording material employed in the practice of the invention can be on a wide variety of supports. Typical supports include cellulose nitrate film, cellulose ester film, poly(vinyl acetal) film, polystyrene film, poly(ethylene terephthalate) film, polycarbonate film and related films or resinous materials, as well as glass, paper, metal and the like. However, if the support is an insulator, the recording element must also include an electrically conductive layer positioned between the support and the charge sensitive layer. Typically a flexible support is employed, especially a paper support. The paper support can be coated with baryta and/or a solvent holdout layer.

The charge sensitive layers used in the practice of the invention can contain addenda commonly employed in thermographic and photothermograhic elements. Addenda in the charge sensitive layers useful in the practice of the invention include toners, also known as activator toners, such as described in U.S. Pat. No. 3,457,075 of Morgan et al., issued July 22, 1969; U.S. Pat. No. 3,672,904 of deMauriac, issued June 27, 1972 and U.S. Pat. No. 3,801,321 of Evans et al., issued April 2, 1974; plasticizers and/or lubricants, surfactants, matting agents, brightening agents, light absorbing materials, filter dyes, and the like also as described in these patents.

The various components of the charge sensitive materials employed in the practice of the invention can be prepared for coating by mixing such components with aqueous solutions or suitable organic solvent solutions depending on the particular charge sensitive material. The components can be added using various procedures known in the photographic art.

The charge sensitive layer of a recording material employed in the practice of the invention can be coated by using various coating procedures known in the photographic art including dip coating, air knife coating, curtain coating or extrusion coating using hoppers of the type described in U.S. Pat. No. 2,681,294 of Beguin, issued June 15, 1954. If desired, two or more layers can be coated simultaneously by procedures known in the art.

An especially useful charge sensitive, resistive, dry developable recording material comprises an electrically conductive support having thereon a layer approximately 10–20 microns (μm) in thickness comprising (a) an imageforming combination including (i) a silver salt of a long chain fatty acid, such as silver behenate or silver stearate, with (ii) a reducing agent as described, in (b) a polymeric binder, also as described. The visible light insensitivity of this recording material allows it to be handled in room light; and with the appropriate choice of image to current converter, the recording material has the ability to record images from a wide spectrum of different forms of radiation. Further, the proper choice of image to current converter allows the recording process to function selectively in environments containing more than one form of radiation, e.g. X-ray exposures in the presence of light.

Overall heating of the recording material can be accomplished in a variety of known ways, for example, by placing the recording material on a heated platen, by passing the recording material between heated rollers, or by applying radiant energy, e.g. from heating lamps, microwave devices, ultrasonic devices, etc., to the recording material. A useful temperature for producing the desired developed image is typically within the range of about 80° C. to about 250° C. such as about 100° C. to about 160° C. The optimum range will depend on several factors such as the desired image, the ingredients of the particular recording material, etc. The time of overall heating typically ranges from about 0.1 second to about 120 seconds depending upon the particular recording material and more importantly, the type of heating device employed. Heating is accomplished under atmospheric pressure conditions, however, pressure above or below this level may be used if desired. When the recording material is heated above the critical temperature, the metal compound and reducing agent react in the image areas reducing the metal compound to the corresponding free metal. The free metal thereby produced provides a visible reproduction of the applied electrical current which varies in intensity according to the charge density produced in the recording material.

Figure 1B:
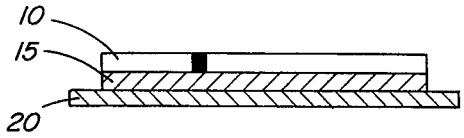

Referring now to the drawings, and particularly to FIGS. 1*a* and 1*b*, one embodiment of the novel electrographic process of the invention is depicted schematically. In this embodiment, a charge-sensitive, resistive recording layer 10 is placed upon a grounded electrically conducting backing or support plate 15. A current is selectively applied to the recording layer 10 by the point of a metal stylus 16, which is raised to a high voltage relative to the backing 15 by a voltage source 17, and brought into moving contact with the exposed surface of the recording layer 10. Upon contacting the recording layer with the stylus 16, a current flows in the areas of the recording layer contacted by the stylus and forms a developable pattern of nuclei sites (i.e. a latent image) thereon. The charge density produced by the stylus in the contacted areas of the recording layer need not be sufficient to produce a visible change in the recording layer 10; however, the charge density is sufficient to produce a latent image in the recording layer in those areas contacted by the stylus. Although a particular technique to produce an imagewise current flow through the recording layer 10 has been described, techniques generally known to the art may be used and are intended to be encompassed herein. These known techniques include, for example, contacting the recording layer 10 with an electrostatically charged stencil and scanning the layer 10 with a beam of electrons.

To develop the latent image formed in the recording element by any one of the procedures described above, the recording element is moved into contact with a heated metal platen 20 which serves to substantially uniformly heat the entire recording layer 10. Platen 20 may be brought into contact with either of the planar surfaces of the recording element to effect development of the latent image. Upon heating the recording element to a temperature at which the latent image becomes visible, the recording element is immediately moved out of contact with the heated platen 20.

Using a typical charge sensitive resistive recording layer (a Dry Silver material manufactured by Minnesota Mining and Manufacturing Co., more particularly Type 7743 photothermographic paper), and an electrode of known area, the following reflection densities in the developed image areas were achieved as a function of charge density for four different applied voltages.

| Charge Density (Microcoulomb/cm$^2$) | Reflection Density | | | |
|---|---|---|---|---|
| .72 | .50 | .51 | .64 | .39 |
| 1.08 | .93 | 1.0 | 1.0 | 1.0 |
| 1.80 | 1.4 | 1.4 | 1.4 | 1.5 |
| Voltage (Kilovolts) | 3.0 | 3.5 | 4.0 | 4.5 |

The table shows that the reflection density is dependent among other factors on the charge density and is substantially independent of the voltage applied.

Dry silver papers are commercially available from the 3M Company and have been described both in the patent literature and in articles published by the 3M Company, for example, U.S. Pat. No. 3,457,075 and the article of D. A. Morgan, T. W. Werner and W. H. Libby (3M Company) "Dry Silver Recording Materials for Display Purposes", Information Display pages 44–47 May/June 1969.

More particularly, the following structural, qualitative data for type 7743 paper has been determined by laboratory analysis:

| | |
|---|---|
| Structure | 3.0 micron (μm) overcoat No. 1<br>0.5 μm overcoat No. 2<br>0.9 μm binder layer coated on Baryta in a gelatin filler layer |
| Polymers | overcoat No. 1-vinyl acetate<br>overcoat No. 2-copoly (vinyl acetate-vinyl chloride)<br>binder-Butvar a poly-vinyl butyral available from Monsanto Co. |
| Silver | 58 mg/ft$^2$ |
| Bromide | 9.0 mg/ft$^2$ |
| Mercury | 4,3 mg/ft$^2$ |
| Spectrographic | aluminum present in coating as $Al_2O_3$. Gravimetric Analysis-230 mg/ft$^2$ |
| Toner | Phthalazinone ∫ 30 mg/ft$^2$ |
| Developer | 2'-methylene bis (4,5-dimethyl-6-t-butyl phenol) |
| Fatty Acid Ratio-mole percent basis | $C_{16}$-1%<br>$C_{18}$-8%<br>$C_{20}$-30%<br>$C_{22}$-61% |
| Free Acid | 1.4 meq/ft$^2$ |

Figure 2A:
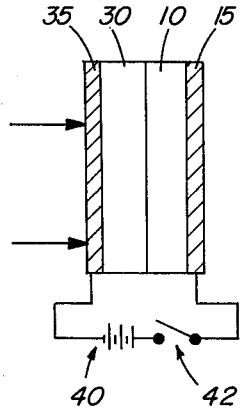
FIGS. 2*a* and 2*b* illustrate schematically an electrophotographic process embodied by the invention.
Figure 2B:
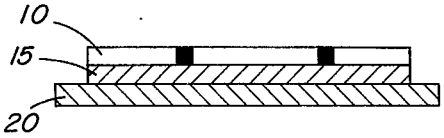

Another embodiment of the inventive process is illustrated in FIGS. 2*a* and 2*b*. In this embodiment, the developable nuclei sites, i.e., latent image, is formed by sandwiching a charge sensitive, resistive recording layer 10 and an image to current converter 30, preferably a photoconductive layer, between a pair of electrically conductive backings 15 and 35, respectively. A high potential electric field is established across the photoconductive and recording layers by connecting the conductive backings 15 and 35 to a D.C. voltage 40. The electric field across the layers is controlled by a switch 42. Latent image formation is effected by imagewise exposing the photoconductive layer 30 through the transparent conductor 35, to actinic radiation. Such exposure serves to selectively increase the conductivity of the photoconductive layer in those regions exposed to actinic radiation. When switch 42 is closed, thereby establishing an electrical field across the layers, an imagewise current flow is produced through the recording layer 10, such current flow occurring in those regions of the recording layer in juxtaposition with the exposed portions of the photoconductive layer. After a charge density of less than 1 millicoulomb/cm$^2$, preferably approximately 1 microcoulomb/cm$^2$, has been produced in the current exposed portions of the recording layer, switch 42 is opened, thereby disrupting the current flow. The described technique for the application of voltage across the photoconductive and recording layers is illustrative, and a variety of techniques known in the art may be used and are intended to be encompassed herein. Thus, for example, a grid controlled corona charger could be substituted for the voltage source 40 and conducting backing 15 of the recording element 10.

To render the latent image in layer 10 visible, the recording element is moved out of contact with the photoconductive layer and uniformly heated. Such heating is effected by merely positioning the recording element in heat-transfer relationship with the heated metal platen 20. Upon heating the entire recording element to a temperature at which the latent image becomes visible, the recording element is removed from the platen.

Figure 3:
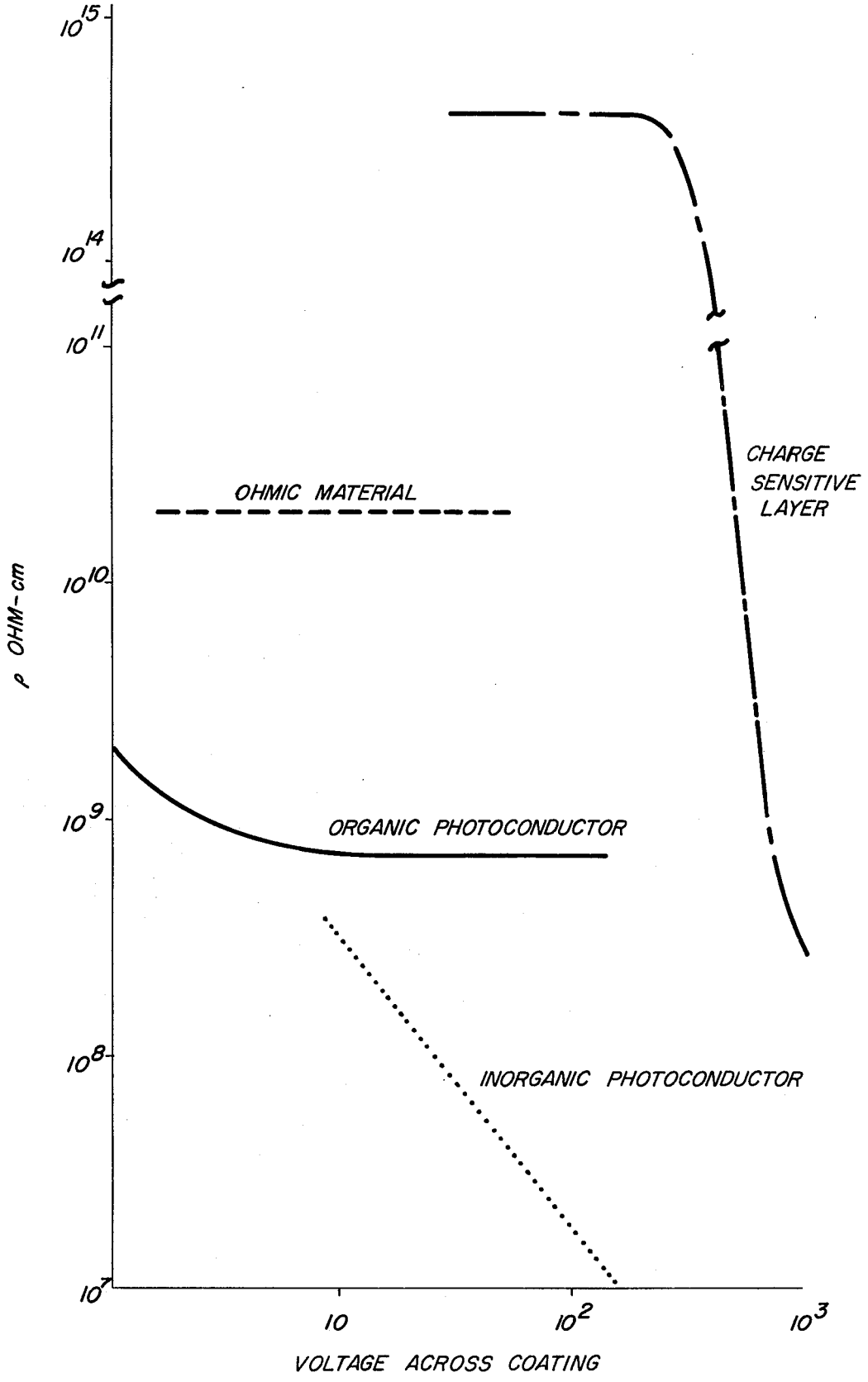
FIG. 3 is a graph showing the resistivity of selected coatings as a function of applied voltage.

In the above described embodiment, it is advantageous to select a photoconductor 30 so that at the operative voltages of the invention, the impedances of the recording layer 10 and the photoconductive layer 30 are closely matched, preferably so that the relative impedances differ by no more than approximately $10^5$ ohms. FIG. 3 shows in graph form the resistivity data of an illustrative organic photoconductor, an inorganic photoconductor and a charge sensitive layer useful in the invention as a function of applied voltage. For the particular charge sensitive layer shown, which comprises a charge sensitive coating approximately 10 μm thick overcoated on a sublayer approximately 10 μm thick, preferred operation is obtained with a potential of approximately 1 kilovolt (i.e. an electric field strength of approximately $5\times10^5$ volts/cm) across the layer. As shown in the graph, the organic photoconductor demonstrates ohmic behavior with the application thereto of the preferred voltage, but the resistivity of both the recording layer and the inorganic photoconductor changes rapidly in the operating voltage range (it decreases sharply with increasing potential). For comparison, the graph also shows the resistivity behavior of an ohmic material.

The resistivity data shown in the graph was obtained by separately measuring the current-voltage characteristic of each sample coating at room temperature using a mercury contact sample holder to make a mercury contact to the surface of the coating. To eliminate the possibility that even a micro-thickness surface air gap might affect the measured resistivity, exposures were also made with an evaporated metal (gold or aluminum) electrode on the surface of the charge sensitive and photoconductor coatings.

Figure 4:
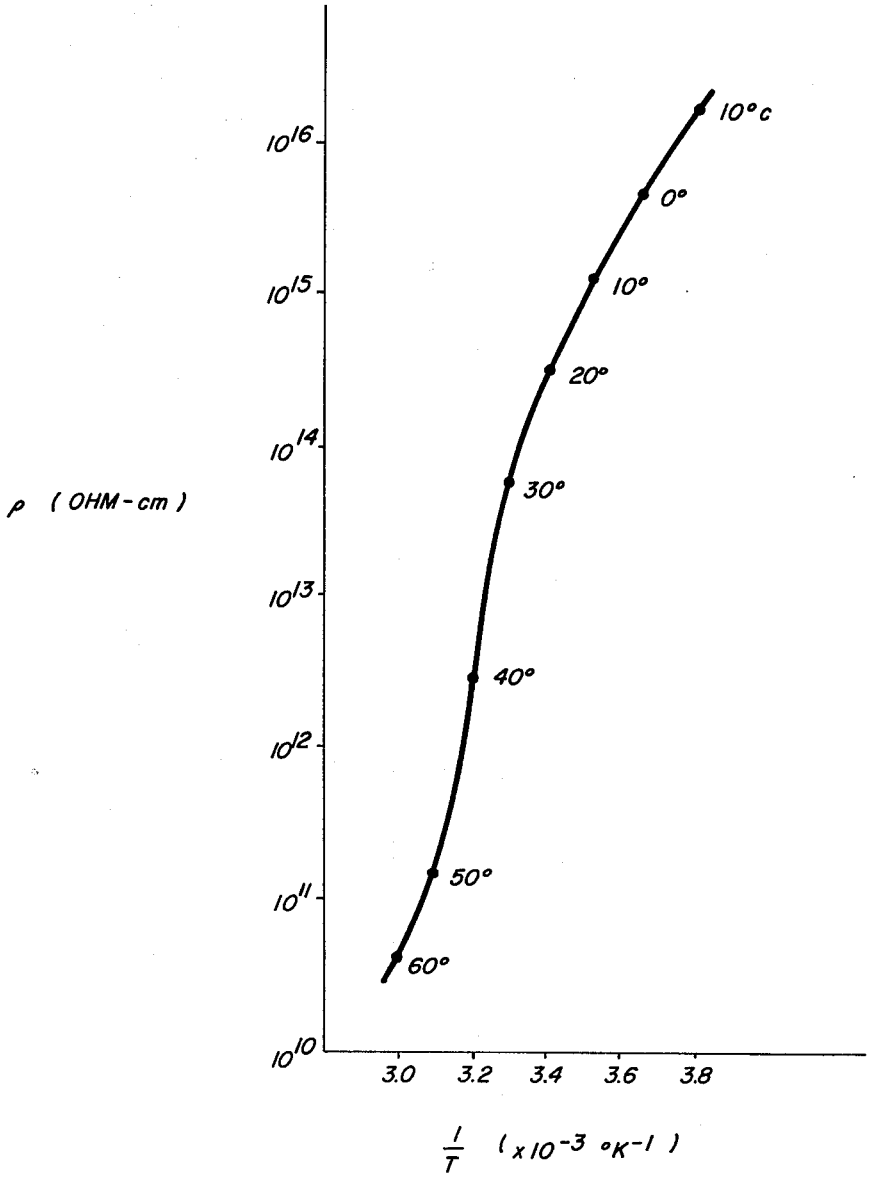
FIG. 4 is a graph showing the resistivity of the illustrative charge-sensitive layer shown in FIG. 3 as a function of temperature.

FIG. 4 shows in graph form the resistivity data for the same charge sensitive layer illustrated in FIG. 3 at various ambient temperatures. The data was taken at a voltage of 400 volts, or $2\times10^5$ volts/cm, which is within the ohmic response range of the layer. As can be seen from the graph, the resistivity of the charge sensitive layer varies widely with temperature, with the largest decrease in resistivity occurring in the neighborhood of 40° C. It may also be noted that the dielectric strength of the layer varies with temperature. At low temperatures the layer can withstand about 1400 volts before beginning to break down electrically. At 30° C. the breakdown voltage increased to 1800 volts and at 40° C. to 2100 volts.

Figure 5A:
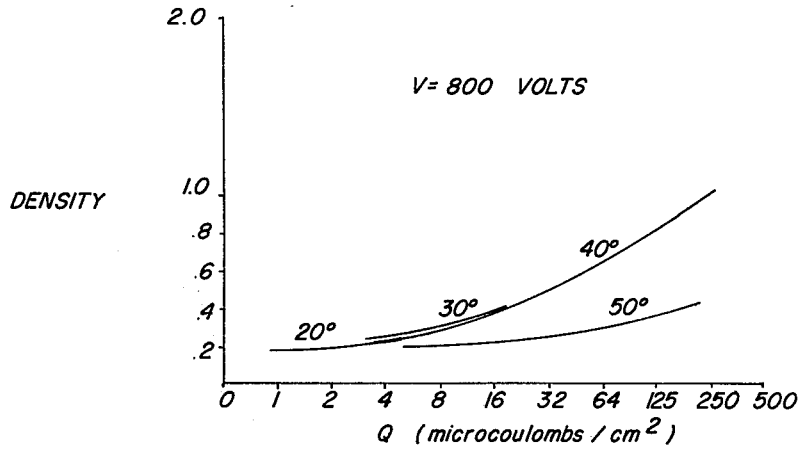
FIGS. 5*a* and 5*b* show the charge of sensitometry of such charge-sensitive layer at various temperatures shown in FIG. 4 at an applied voltage of 800 volts and 1600 volts, respectively.
Figure 5B:
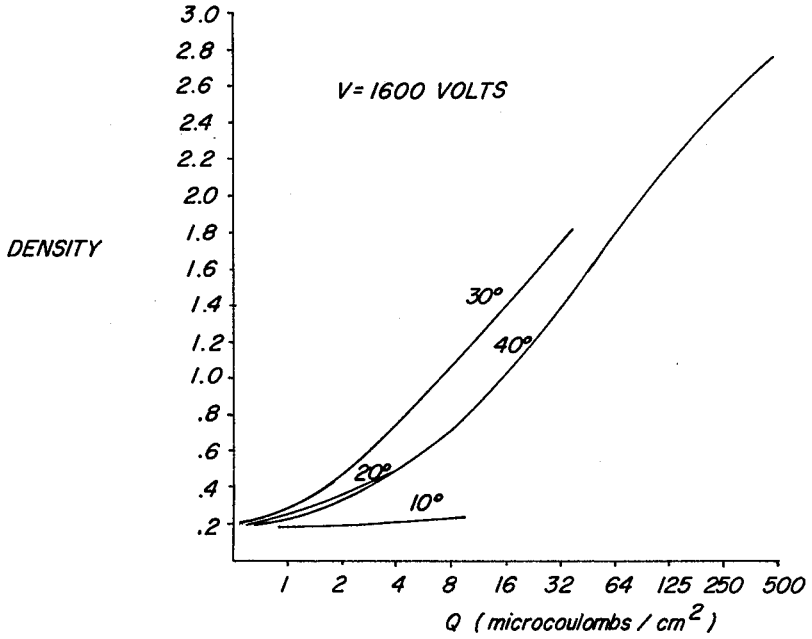

FIG. 5*a* shows the charge sensitometry of the layer at temperatures of 20, 30, 40 and 50° C. at an applied voltage of +800 volts and FIG. 5*b* shows the charge sensitometry of the layer at temperatures of 10, 20, 30 and 40° C. at an applied voltage of +1600 volts. By referring to FIG. 4 it can be seen that the charge-sensitive layer has a resistivity greater than $10^{15}$ ohm-cm at a temperature of 10° C. at an applied voltage of 400 volts. At this level of resistivity only a barely perceptible image can be formed as shown in FIG. 5*b*. No image could be formed at the higher resistivity levels of the charge-sensitive layer measured at 0° C. and −10° C.

The 10 μm charge-sensitive coating utilized in FIGS. 3–5 was prepared in two components:

| | | |
|---|---|---|
| Part A | | |
| | 4.2 grams | silver behenate |
| | 30 grams | 4.3% polyvinyl butyral in 1:1 acetone:toluene |
| Part B | | |
| | 1.90 grams | benzenesulfonamidophenol |
| | 0.27 grams | 2.6-dichlorobenzene-sulfonamidophenol |
| | 0.31 grams | succinimide |
| | 0.12 grams | 5-methylbenzimidazole |
| | 20 grams | 4.3% polyvinyl butyral in 1:1 acetone:toluene |

The components were ball milled for 72 hours and were mixed just prior to coating.

The resistivity of the recording layers useful in the present invention may also be affected by exposure history, the direction of the applied field and, when sandwiched with a photoconductor, by air gap effects and photoconductor effects. The large number of variables affecting the resistance of the recording layers useful in the present invention coupled with their non-ohmic behavior at higher applied fields, prohibits the production of meaningful resistivity data for such layers at the operating voltage range of the invention. The resistivity values reported hereinafter in the specification for particular charge sensitive recording materials are, therefore, values measured under temperature and voltage conditions which produce ohmic behavior.

Figure 6:
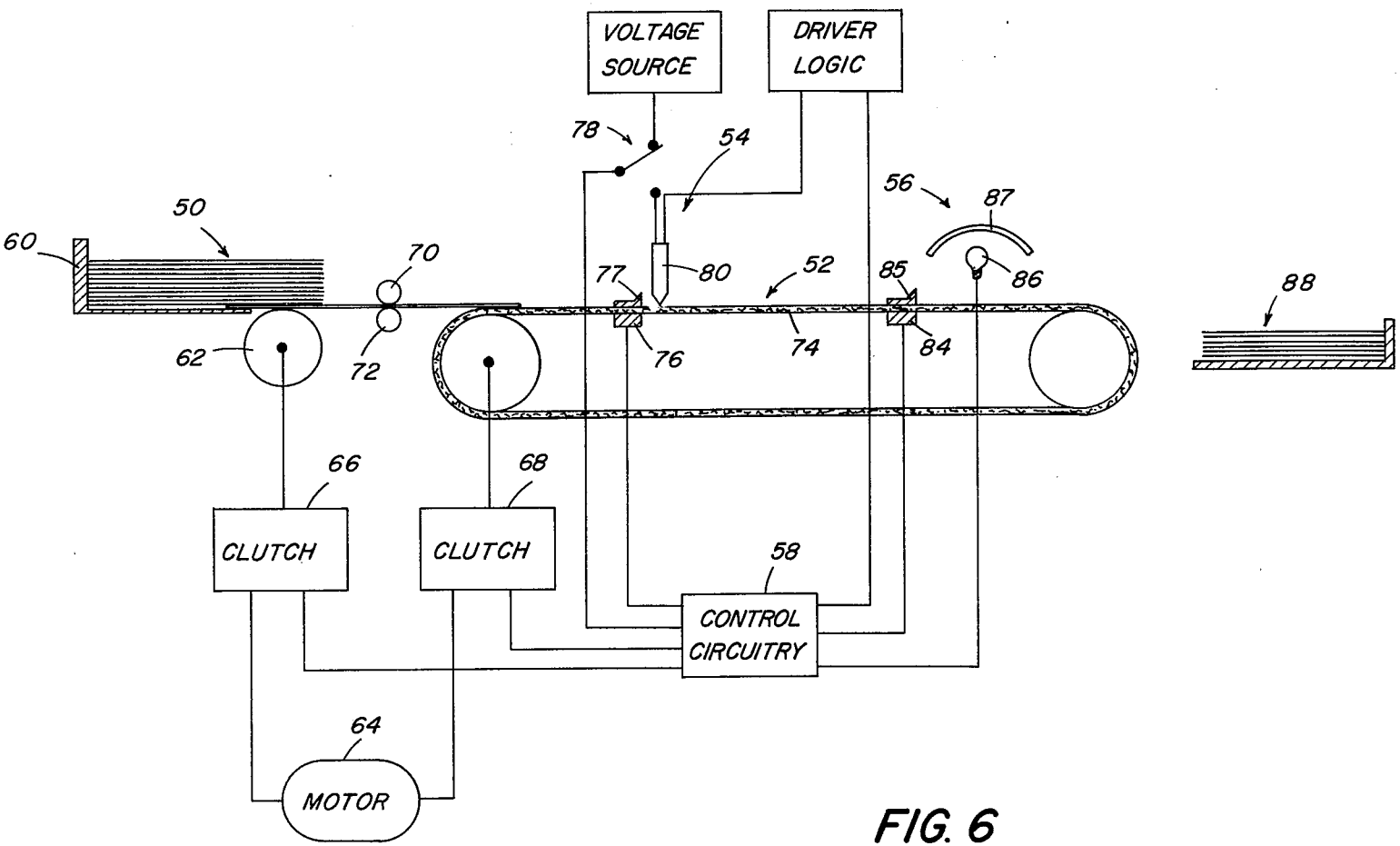
FIG. 6 is a schematic diagram of an electrographic recording apparatus for carrying out the process of the invention.

Referring now to FIG. 6, an illustrative embodiment of a recording apparatus for producing a visible image in an electrosensitive recording element is depicted schematically. The recording apparatus comprises generally a supply hopper 50, a transport assembly 52, an exposure station 54, a processing station 56 and control circuitry 58. To operate the apparatus, a plurality of recording elements are located in a stacked condition onto a feeder shelf 60 of the supply hopper 50. A feed roller 62 extends through an opening in the feeder shelf 60 and is maintained in frictional contact with the lowermost recording element in the stack. When the apparatus is turned on by depressing a start button (not shown), the control circuitry 58 energizes a motor 64 and activates clutches 66 and 68 which couples the drive from the motor 64 to the feed roller 62 and the transport assembly 52, respectively.

A recording element is fed by the feed roller 62 from the bottom of the recording element stack through a pair of separator rollers 70 and 72 and onto an electrically conductive, heat resistant conveyor belt 74. As the recording element moves along the conveyor belt 74, means are provided to sense the arrival of the leading edge of the recording element at the exposure station 54. The sensing means comprises a microswitch 76 arranged and disposed so that the leading edge of the recording element closes a contact 77 of the microswitch 76 as the recording element passes therepast. The closing of the contact 77 causes a signal to be sent to the control circuitry 58 which deactivates the clutches 66 and 68 stopping the recording element at the exposure station 54.

The control circuitry then closes a switch 78 coupling a source of potential 79 to a metal stylus 80, raising the voltage of the stylus relative to the conveyor belt 74. The control circuitry then activates the stylus driver logic 82 which moves the stylus 80 into contact with the recording element in accordance with an image pattern that is to be recorded. Upon contacting the recording element, a current flows in the areas of the recording element contacted by the stylus and forms a developable pattern of nuclei sites (i.e. a latent image) thereon. The charge density produced by the stylus 80 in the contacted areas of the recording element need not be sufficient to produce a visible change in the recording element; however, the charge density is sufficient to produce a latent image in the recording element in those areas contacted by the stylus 80.

To develop the latent image formed in the recording element, the control circuitry 58 activates the clutch 68 to again couple the drive from the motor 64 to the conveyor belt 74. As the recording element moves along the conveyor belt 74, means are provided to sense the arrival of the leading edge of the recording element in the processing station 56. The sensing means comprises a second microswitch 84 arranged and disposed so that the leading edge of the recording element closes a contact 85 of the microswitch 84 as the recording element passes therepast. The closing of the contact 85 causes a signal to be sent to the control circuitry 58 which deactivates the clutch 68 stopping the recording element at the processing station 56. The control circuitry then activates a heating means 86, such as an infrared lamp surrounded by a reflector 87 which serves to substantially uniformly heat the entire recording element. Upon heating the recording element to a temperature at which the latent image becomes visible, the control circuitry 58 activates the clutch 68 coupling the drive from the motor 64 to the conveyor belt 74 which feeds the recording element into a receiving hopper 88.

If desired, the recording apparatus can be readily modified to provide continuous operation. To accomplish this result, the control circuitry 58 is modified so as to continuously couple the transport assembly 52 to the drive motor 64 and the exposure station 56 is modified to include a plurality of stylii which are selectively energized as the recording element moves therepast.

Although a particular technique to produce an imagewise current flow has been described for use in the recording apparatus, other techniques generally known to the art may be used and are intended to be encompassed herein. These known techniques include, for example, using a photoconductive layer as an image to current converter in the manner shown in FIG. 2*a*, contacting the recording element with an electrostatically charged stencil and scanning the recording element with a beam of electrons. Likewise, heating of the recording element can be accomplished by other techniques generally known to the art, for example, by passing the recording element over a heated platen or through heated rollers.

The following examples will serve to further illustrate the present invention.

EXAMPLE 1

A sheet of Type 777 photothermographic paper, manufactured by Minnesota Mining and Manufacturing Company was placed on a metal plate with the emulsion side of the paper facing away from the plate. The plate potential was raised to 3,000 volts positive with respect to a metal stylus. The grounded metal stylus was brought into contact with the emulsion side of the paper and was moved across the emulsion at the rate of about 5 inches per second. The Type 777 paper was then removed from the metal plate and brought into contact with a heated metal platen. Upon uniformly heating the Type 777 paper for three seconds at 140° C. an image appeared in those areas contacted by the grounded electrode. The following structural, qualitative and quantitive data for Type 777 paper has been determined by laboratory analysis:

| | |
|---|---|
| Structure | 2–3 μm overcoat<br>6–12 μm binder layer coated directly on paper. No filler. |
| Polymers | overcoat-cellulose acetate<br>binder-Butvar a poly-vinyl butyral available from Monsanto Co. |
| Silver | 54–69 mg/ft$^2$ |
| Bromide | 1.8–2.7 mg/ft$^2$ |
| Mercury | 2.1–4.2 mg/ft$^2$ |
| Spectrographic aluminum | 5–13 mg/ft$^2$ |
| Silicon | 1–7 mg/ft$^2$ |
| Zinc | 0.9–11 mg/ft$^2$ |
| Toner | Phthalazinone ~ 25 mg/ft$^2$ |
| Developer | 2,2′ methylene bis (4-methyl-6-t-butyl phenol) |
| Fatty Acid Ratio-mole percent basis | $C_{16}$-2–3%<br>$C_{18}$-29–30%<br>$C_{20}$-8–10%<br>$C_{22}$-57–60% |

EXAMPLE 2

An aggregate photoconductive composition comprising poly-4,4′-isopropylidenediphenylene carbonate (Lexan 145 General Electric Company), the photoconductor 4,4′-diethyl-amino-2,2′-dimethyltriphenylmethane (40% by weight of the total solids) and 2% by weight of dye comprising a 60:40 weight ratio mixture of 4-(4-dimethylaminophenyl)-2,6-diphenylthiapyrylium fluoroborate and 4-(4-dimethylaminophenyl)-2-(4-ethoxyphenyl)-6-phenylthiapyrylium fluoroborate and dichloromethane solvent was prepared by the technique described in U.S. Pat. No. 3,679,408 issued July 25, 1972, incorporated herein by reference. The resultant composition was coated on a conductive support comprised of poly(ethylene terephthalate) film base having a transparent conductive layer on the surface thereof. The photoconductive layer was then overcoated with cellulose nitrate at a coverage of 0.194 g/ft$^2$. The photoconductive element was placed in a sandwich with a sheet of Type 790 photothermographic paper manufactured by the Minnesota Mining and Manufacturing Company so that the active surfaces of the element and the paper were in interfacial contact. An Eastman Kodak Company Wratten filter No. 70 was placed between the photoconductive layer and the projector to eliminate any direct exposure of the type 790 paper to visible radiation to which it is sensitive. The unfiltered intensity of the tungsten source projector was 20 foot-candles. A voltage of 2500 volts was applied across the sandwich formed by the aggregate photoconductor and the Type 790 paper simultaneously with the imagewise exposure of the photoconductive layer. The conductive backing of the photoconductive was made positive with respect to a metal filled, rubber conducting layer sold under the tradename "Eccoshield SV" by Emerson and Cummings which was placed in electrical contact with the paper side of the Type 790 paper. The simultaneous voltage application and imagewise exposure of the photoconductor was maintained for 3 seconds followed by separation of the Type 790 paper from the photoconductor in the dark after the voltage was reduced to zero. The type 790 paper was processed by uniformly heating the emulsion side for 10 seconds at 130° C. The current exposed portions of the paper darkened producing a negative-to-positive image of good quality. The steady state current density to obtain $D_{max}$ was measured to be about 0.1 to 1.0 microampere/cm$^2$. The following structural, qualitative and quantitative data for Type 790 paper has been determined by laboratory analysis:

| | |
|---|---|
| Structure | 2–3 μm overcoat<br>6–9 μm binder layer<br>No filler |
| Polymers | overcoat-cellulose acetate<br>binder-Butvar a poly-vinyl butyral available from Monsanto Co. |
| Silver | 40 mg/ft$^2$ |
| Bromide | 1.1 mg/ft$^2$ |
| Mercury | 0.6 mg/ft$^2$ |
| Spectrographic | |
| aluminum | 15 mg/ft$^2$ |
| silicon | 2 mg/ft$^2$ |
| Toner | Phthalazinone ~ 25 mg/ft$^2$ |
| Developer | 2,2'-methylene bis (4-methyl-6-t-butyl phenol) |
| Fatty Acid Ratio-mole percent basis | $C_{16}$-3%<br>$C_{18}$-30%<br>$C_{20}$-10%<br>$C_{22}$-57% |

EXAMPLE 3

A print was made under identical conditions to that of Example 2 except that the polarity of the applied voltage was reversed, Again, a good quality negative-to-positive image was obtained.

EXAMPLE 4

A sheet of the light sensitive, Type 777 photothermographic paper manufactured by the Minnesota Mining and Manufacturing Company was placed in face to face contact with a transparent aggregate photoconductive element prepared as described in Example 2. The Type 777 paper was then electrically exposed by the procedure described in Example 2 and heat processed to produce a visible image. Next, the Type 777 paper containing the heat processed image was again brought into contact with the photoconductive element and electrically exposed by optically projecting an image onto the photoconductive element which was rotated with respect to the first exposure. Again, the paper was heat processed to produce a superimposed visible image corresponding to the rotated projected image.

A second sheet of the light sensitive, Type 777 photographic paper was light exposed to an optical image and heat processed to produce a visible image. The Type 777 paper containing the heat processed image was then brought into contact with the photoconductive element and electrically exposed by the procedure described in Example 2 but with the image projected onto the photoconductive element rotated with respect to the first exposure. Again the paper was heat processed to produce a superimposed, rotated image.

A third sheet of the Type 777 photothermographic paper was placed in face to face contact with the photoconductive element and electrically exposed by the procedure described in Example 2 and heat processed to produce a visible image. The Type 777 paper containing the heat processed image was viewed under red safe light conditions and then light exposed to an optical image which was rotated with respect to the first exposure. Again the paper was heat processed to produce a superimposed, rotated image.

This example illustrates the capability of the present invention to record information on a charge sensitive recording material and subsequently update such information. If the charge sensitive recording element is also light sensitive, a combination of electrical and light exposures can be used to form the original and updated images on the recording element.

EXAMPLE 5

A photoconductive composition was prepared by the transformation of yellow othorombic lead oxide (Evans Lead Corporation) designated as Evans Fumed Litharge, to tetragonal lead oxide. The transformation was performed in accordance with the teachings of U.S. Pat. No. 3,577,272 issued May 4, 1971, incorporated herein by reference. Forty grams of the tetragonal lead oxide powder was placed in a 250 milliliter mill jar, 26.7 grams of Pliolite S-5, 30% in toluene, (pliolite is a trademark of Goodyear Tire and Rubber Co. for a 85:15 styrene-butadiene copolymer) and 29.3 grams toluene were added to produce a 50% solids mixture. The mixture was ball milled for 24 hours and then filtered through silk bolting cloth (550 mesh) and coated on a polyester film support on which was vacuum deposited a layer of aluminum. The 90 micron thick coating was then placed in a dark drying box for 72 hours. The active surface of the photoconductive element was placed in face to face contact with the active surface of a sheet of Type 790 photothermographic paper manufactured by the Minnesota Mining and Manufacturing Co. A voltage of 3500 volts was supplied across the sandwich formed by the photoconductor and the Type 790 paper simultaneously with an X-ray exposure of the photoconductive layer. The conductive backing of the photoconductor was made positive with respect to an Emerson Cummings "Eccoshield SV" metal filled, rubber conducting layer which was placed in electrical contact with the paper side of the Type 790 paper. The X-ray source was an unfiltered paxitron 504 unit operating at 110 KV and 3 ma. The simultaneous voltage application and imagewise exposure of the photoconductor was maintained for 5 seconds followed by a separation of the Type 790 paper from the photoconductor in the dark. The Type 790 paper was processed by uniformly heating the emulsion side for 4 seconds at 140° C. A radiographic print of good quality resulted.

The steady state current density to obtain $D_{max}$ was measured to be approximately 0.1 microampere/cm$^2$. Control experiments consisting of either (1) 45-second exposure of the lead oxide photoconductive layer with no field applied; or (2) 2-minute exposure directly on the Type 790 paper followed in both instances by the heating step produced no visible images.

EXAMPLE 6

A print was made under identical conditions to that of Example 5 except that the charge sensitive paper used did not contain any light sensitive silver halide. The charge sensitive layer was prepared by ball-milling the following components for 72 hours:

| | |
|---|---|
| Silver behenate | 168.0 grams |
| Behenic acid | 68.0 grams |
| Poly(vinyl butyral) | 120.0 grams |
| Phthalimide | 34.0 grams |
| Acetone-toluene | 2.0 liters |

This silver behenate-behenic acid dispersion was then combined with the following addenda in the order indicated, mixed thoroughly and coated on a suitable paper support at 6.0 g/ft$^2$

| | |
|---|---|
| Silver behenate-behenic acid dispersion (preparation described above) | 142.0 ml |
| Acetone-methanol solution (33:1 by volume) containing 0.1% by weight 3-carboxymethyl-5-[(3-methyl-2-thiazolidinylidene)-1-methylethylidene]rhodanine and 0.03% by volume triethylamine | 7.2 ml |
| Acetone solution containing 10% by weight 2,2'-dihydroxyl-1,1'-binaphthyl | 33.0 ml |
| Acetone solution containing 10% by weight 2,4'-dihydroxybenzophenone | 5.0 ml |
| Acetone-toluene (1:1 volume) | 46.0 ml |
| Methanol solution containing 1% by weight mercuric acetate | 12.0 ml |

The resolution of the resultant prints after exposure and thermal processing was 10 lines/mm with brownish appearing $D_{max}$ areas. All of the processing steps were carried out under red safe light conditions as an added precaution.

Another piece of the same recording element was pre-exposed to room lights through 0.3 neutral density step wedge. The exposure was for 1 hour at an intensity of about 100 ft. candles. A second recording element, identical in every respect to the recording element described above except that it did contain silver halide, was pre-exposed with light as outlined above. Both samples were subsequently electrically exposed as in Example 5 in the same regions as the light exposure and heat processed. The recording element containing no silver halide was heat processed under room light conditions; the recording element containing siliver halide was heat processed under red safe light conditions. The recording layer containing the silver halide showed extreme fogging due to the light exposure resulting in a low radiographic image discrimination. The recording layer which did not contain silver halide produced a good quality radiographic image with excellent image discrimination.

Yet another piece of the recording element containing no light sensitive silver halide was overcoated with a photoconductor containing a solvent hold-out layer. The integral photoconductor-recording element package was electrically exposed by applying a positive 2 kilovolt potential between the conducting layer of the photoconductor and a flexible conducting layer, sold under the trademark Velostat by Custom Materials, placed in contact with the recording element while simultaneously exposing the photoconductor to an imagewise pattern of light. The exposure was made through a negative silver original using a Xenon light source which provided 40 foot candles of illumination. As an added precaution, a Wratten No. 70 filter was placed between the light source and the integral package. The package was then processed for 10 seconds at 100° C. to produce a negative to positive image in the recording layer. Finally, the negative to positive image was thermally transferred to a clear thermoplastic support.

Two other integral photoconductor-recording element packages were electrically exposed as described above except that a negative 2 kilovolt potential was applied between the photoconductive and recording layers. The latent images in the recording elements were thermally transferred to clear thermoplastic supports and then heat processed to produce negative to positive images.

EXAMPLE 7

A charge sensitive, visible light insensitive formulation was prepared by ball milling the following components for 24 hours:

| | |
|---|---|
| Silver behenate | 2.1 grams |
| Pimelic acid | 0.05 grams |
| Pthalazinone | 0.2 grams |
| HYCAR 1041* 5% in 1:1 toluene:acetone | 30.0 grams |

*HYCAR 1041 is an acrylonitrile-butadiene copolymer manufactured by the B. F. Goodrich Rubber Company.

This silver behenate-pimelic acid dispersion was then combined with the following components in the order indicated under mild agitation

| | |
|---|---|
| 2,2' methylene bis (6 tert-butyl-4-methyl phenol) | 1.5 grams |
| Mercury chloride | 0.02 grams |
| HYCAR 1041, 5% in 1:1 toluene:acetone | 20.0 grams |

The total formulation was then knife coated at 0.01 inches wet thickness on a conductive support and air dried for 24 hours at room temperature. The dried coating with an average thickness of 14 microns has an ohmic resistivity of $1.19\times10^{10}$ ohm-cm at room temperature at an applied voltage of 100 volts. A density step wedge ($\Delta$D-0.3) was placed against the transparent conductive support of a photoconductive element prepared as described in Example 5. The photoconductive element was placed in a sandwich with the charge sensitive element so that the active surfaces of the two elements were in interfacial contact. A voltage of 3500 volts was applied across the sandwich simultaneously with the projection of a light image on the photoconductive layer through the transparent conductive backing thereof. The intensity of the 3000° K. tungsten light source was 2 footcandles.

The conductive backing of the photoconductor was made positive with respect to the conductive support of the charge sensitive layer. The simultaneous voltage application and imagewise exposure of the photoconductor was maintained for 40 seconds. The charge sensitive element was then separated from the photoconductor and heat processed for 30 to 45 seconds at 105° C. The current exposed portions of the charge sensitive layer darkened producing a dense, uniform negative to positive image in which 5–6 steps were clearly resolved.

EXAMPLE 8

A Print-a-Pix tube (a trademark of the Litton Corporation used to designate a cathode ray tube having a plurality of wires embedded in the tube face) was used to electrically expose two recording elements. The recording elements were a sheet of Type 777 paper manufactured by Minnesota Mining and Manufacturing Company and a sheet of material prepared as described in Example 6. The electron beam of the Print-a-Pix tube was focused and deflected so that it scanned across only a single line of the fine wires (1000/inch). The time required to scan the 1¼ inch single line of wires was about 50 microseconds with a blank retrace time of about 10 microseconds. The electron beam spot size was approximately equal to the wire diameter and had a current of 5 microamperes. The accelerating potential was 20 kilovolts. Each of the recording elements was brought into virtual contact with the face of the tube and exposed for 1 second. The two elements were heat processed after electrical exposure for 10 seconds. The Type 777 paper was heated to 120° C. and the other to 100° C. A line image corresponding to the fine wires was visible on each of the recording elements.

EXAMPLE 9

A grid controlled corona (GCC) device as disclosed in U.S. Pat. No. 3,370,212 to L. E. Frank was used to expose Type 777 photothermographic paper. The GCC device consisted of a 4 by 5 inch array of corona wires surrounded by a NESA (a trademark of PPG Industries used to designate an electrically conductive glass) shield on one side and a bare metal stainless steel wire (400 holes/inch) woven screen grid on the other side. Below the screen was a second grid identical to the first grid but coated with a thin organic photoconductive composition. The photoconductive coating covered all surfaces of the screen but did not seal off the openings of the grid. A first sheet of the Type 777 paper was positioned just below the second grid and held flat against a metal vacuum platen which also served as the bottom electrode. With the photoconductive grid in the dark, the exterior surface of the photoconductor was charged by a negative corona to −200 volts with respect to its metal core. The photoconductor was allowed to charge for 3½ seconds. The photoconductor was then exposed for ¾ of a second to a light image. The projection source was a xenon lamp which provided 4 footcandles of illumination on the photoconductive grid. A Wratten No. 29 (red) filter was placed between the lamp and the Type 777 paper to eliminate any direct exposure of the paper to visible radiation to which it is sensitive. During the exposure step all elements of the device were grounded and the photoconductor surface voltage decayed according to the amount of light absorbed. To form a latent image on the Type 777 paper, the imagewise charge pattern on the photoconductive grid was biased with respect to the metal grid such that the negative ions from the corona were attracted through the photoconductive grid in the light struck areas and repelled in the dark areas. During the image forming step the platen was raised to +2 kilovolts to overcome the high series resistance of the paper base and the heat developable layers. After 70 seconds, the elements were again grounded, the Type 777 paper removed and processed for 6 seconds at 130° C. on a heated platen. A useful negative-to-positive image resulted.

A second sheet of Type 777 paper was positioned on the vacuum platen and, with the photoconductive grid in darkness, its exterior surface was charged by a positive corona to +200 volts with respect to its metal core. The exposure, image forming and development steps were then carried out as described above, except that the bias on the photoconductive grid was of opposite polarity such that the negative ions from the corona were repelled in the light struck areas and attracted through the dark areas. The resulting image produced was a positive-to-positive copy of the original light image.

EXAMPLE 10

A sheet of Type 777 photothermographic paper manufactured by the Minnesota Mining and Manufacturing Company was overcoated with a solvent holdout layer (polyvinyl alcohol-PVA) and a layer of Kalvar film. [Kalvar film is a vesicular film having a poly(vinylidene chloride)-acrylonitrile copolymer binder and a diazonium salt sensitizer]. This multilayer element was placed with the Type 777 paper in contact with a transparent aggregate photoconductor, electrically exposed by the procedure described in Example 2 and heat processed at 130° C. for 10 seconds to produce a negative to positive image in the Type 777 paper. This developed image was then used as an optical mask while the integral Kalvar film was exposed to a source of ultraviolet light. Again the multilayer element was heat processed but at a higher temperature, i.e. 150° C., for 10 seconds to develop a positive to positive image in the Kalvar film. Finally, the positive to positive image was thermally transferred to a clear thermoplastic support.

EXAMPLE 11

A persistent photoconductive composition was prepared by adding 40 grams of 3-(p-diphenylamino) phenyl propionic acid to 840 grams of solvent (1,2 dichloromethane) and stirring for 10 minutes. One hundred twenty grams of Vitel P E 101 (a trademark of Goodyear Tire and Rubber Company for a polyester having the chemical formula $C_{29}H_{30}O_8$) was then added to the solution with power stirring for one hour. Next, 4.8 grams of a carbocyanine green sensitizing dye was added to the solution and stirred for ½ hour. Finally, just prior to filtration, 4.0 grams of Modaflow, 10% in 1,2 dichloromethane (Modaflow is a trademark of Monsanto Company for a copoly(ethylene ethylacrylate) coating aid) was added to the solution and the dope was stirred for another ¼ hour. The dope was then filtered and coated on a conductive support comprised of poly(ethylene terephthalate) film base having a 0.4 neutral density nickel evaporated on the surface thereof. The photoconductor was exposed with a number 2 photoflood for 15 seconds at a 10 inch distance while being contacted with a transparency containing clear letters on a high density background. After light exposure, the active surface of the photoconductor was brought into face to face contact with the active surface of a sheet of Type 777 photothermographic paper while working under red safe light conditions. A negative 3 kilovolt potential with respect to the Type 777 paper was applied to the photoconductor's electrode for 3 seconds. The Type 777 paper was then heat processed at 130° C. for 10 seconds to reveal a negative to positive reproduction of the original image. The resolution of the print after thermal processing was approximately 10 lines/-millimeter. Two additional prints were made in the same manner without re-exposing to a light image. The image quality of these prints was approximately the same as the image quality of the first print. To show that the polarity of the applied voltage was insignificant, a fourth print was made by applying a positive three kilovolt potential to the photoconductor. The fourth print was practically indistinguishable from the other three prints.

EXAMPLE 12

A conventional electrographic, zinc oxide photoconductive layer was charged, exposed to an imagewise pattern of actinic radiation and developed with a single component developer comprising iron beads about ½ mil in diameter. The developed photoconductive layer was brought into face to face contact with a sheet of Type 777 photothermographic paper manufactured by Minnesota Mining and Manufacturing Co. The photoconductor and Type 777 paper were placed between two electrodes and 2,000 volts was applied across the package. After separation of the Type 777 paper in the dark and heat processing thereof at 130° C. for 10 seconds, a recognizable image appeared corresponding to the area containing the electrically conducting iron particles.

EXAMPLE 13

An electrographic recording element was prepared in the following manner:

A charge sensitive recording layer was prepared by dissolving 1.5 grams of Formvar 12/85 (a polyvinylformal resin from Monsanto Company) in a solvent mixture consisting of 17.2 ml of toluene and 17.2 ml of acetone by stirring the polymer in the solvent with a magnetic stirrer for two hours at room temperature. The resultant solution of Formvar 12/85 in solvent, 4.2 grams of silver behenate, 0.34 grams of 1,2-H-phthalazinone and 30 agate balls were placed in a 125 ml glass bottle. The mixture was ball milled at approximately 100 rpm for 16 hours. In a separate bottle, 1 gram of Formvar 12/85, 3.0 grams of 2,2'-methylene bis (6-tert-butyl-4 methylphenol) and 0.05 grams of mercuric chloride were dissolved in a solvent mixture consisting of 11.4 ml of toluene and 11.4 ml of acetone by stirring the solids in the solvent for 1 hour at room temperature. After ball milling, the ball milled dispersion and the solution were mixed under red safelight conditions. A hand coating of 0.006 inches wet thickness of the charge sensitive recording layer was made under red safelight conditions on baryta paper. The composite coating was dried in the dark for 16 hours at room temperature in a circulating air box.

Three strips of the electrographic recording were electrically exposed by the procedure described in Example 2 with two exceptions: (1) a step wedge of 0.3 neutral density was used to modulate the light impinging on the photoconductor; and (2) the exposure time was for 10 seconds at a light intensity of 25 foot candles. A small section of each of the recording element strips, cut at right angles to the step wedge, was immediately heat processed. The remaining portions of the recording element strips were not immediately heat processed but were stored under ambient room conditions of temperature and humidity in a dark envelope. At later times, specifically 6 and 14 days after exposure additional small sections of each recording element strip were heat processed. The strips were processed at 90° C. for 15 seconds.

The reflection densities of each of the sections was measured after heat processing and the composite average of such densities are shown in the table below.

| Exposure Step No. (0.3 ND) | Reflection Density | | |
|---|---|---|---|
| 7 | .2 | .2 | .2 |
| 6 | .3 | .3 | .3 |
| 5 | .4 | .4 | .4 |
| 4 | .7 | .6 | .6 |
| 3 | 1.1 | .9 | 1.0 |
| 2 | 1.5 | 1.2 | 1.4 |
| 1 | 1.7 | 1.6 | 1.6 |
| 0 (clear) | 1.8 | 1.7 | 1.8 |
| Days | 0 | 6 | 14 |

The data in the table illustrates the capability of the present invention to store the latent image formed during the imagewise charge exposure of the recording layer for extremely long periods of time with little or no image degradation.

From the foregoing, the beneficial effects of the present invention are readily apparent, a novel electrographic process has been disclosed which avoids the chemical procedures inherent to photography, the mechanical dust pattern transfer procedure of xerography and the moistening procedure of electrolytic electrography. By applying minute imagewise currents to resistive, charge sensitive recording materials followed by uniform heating, a low energy dissipation, high resolution recording process is obtained. The combination of a low energy requirement and a high resolution capability is particularly advantageous in diagnostic medical radiography. Another advantage is that the latent image formed during the imagewise charge exposure of the charge sensitive recording material has a long storage life. Consequently, the exposure and development steps of the inventive process can be separated by an extended period of time. Still another advantage is that the charge sensitive materials can be made light sensitive or light insensitive as desired.

The invention has been described in detail with reference to preferred embodiments thereof, but it will be understood that variations and modifications can be effected within the spirit and scope of the invention. For example, image colors other than black can be realized by incorporating different reducing agents.

A mixture of the current sensitive forming components with the photoconductors could be incorporated into a single layer. To form a latent image, a voltage would be applied to the single layer recording element which is insufficient to generate a current flow through the layer in the absence of light, simultaneously with an imagewise light exposure. After exposure, a visible image would be formed by heat processing.

The reducing agents needed for development of the developable sites in the charge sensitive layer could be coated in a separate layer and then joined together temporarily after the exposure step. One advantage of having separate layers would be a reduction of material cost since one layer containing the reducing agent could be used to develop many resistive, charge sensitive layers containing the reducible metal salts.

Two sided copies can be produced using a multilayer element comprising a first charge sensitive layer, a conducting support and a second charge sensitive layer. The charge sensitive layers can be electrically exposed sequentially or simultaneously using a photoconductive element or elements as an optoelectrical transducer and applying an electrical potential across the photoconductive element(s) and charge sensitive layer(s). After each charge sensitive layer has been electrically exposed, the multilayer element is heat processed to produce separate images on each side of the element.

A multicolored print can be produced using a two element recording device. The first element comprises: (a) an electrically conducting support; (b) a pan-sensitive photoconductive layer; (c) the second element comprises a charge sensitive layer; and (d) an optically transparent electrode; and (e) a multicolored additive filter mosaic divided into a multitude of color filter elements which are constructed to effect selective transmission of predetermined portions of the visible electromagnetic spectrum substantially corresponding to its red, green and blue regions. To produce a color print, the recording element is imagewise exposed to a color original through the mosaic while an electrical potential is applied across the photoconductive and charge sensitive layers. The resulting latent image is then developed by uniformly heating the recording element to produce a color negative image.

We claim:

1. A dry electrographic recording process for producing a visible image in a charge-sensitive recording element having an ohmic resistivity of at least about $1\times10^{10}$ ohm-cm and containing at least one reducible metal salt, said process comprising the steps of:

(a) applying an electric potential to selected portions of said recording element of a magnitude and for a sufficient period of time to produce in said portions a charge density of from approximately 1 microcoulomb/cm$^2$ to approximately 1 millicoulomb/cm$^2$ said charge density forming a developable pattern of latent image sites; and (b) heating the entire recording element substantially uniformly in the presence of a reducing agent until a sufficient quantity of said metal salt is reduced at said image sites to form a visible image.

2. The process of claim 1 wherein said potential applying step comprises disposing one surface of said recording element in electrical connection with a conductive member and contacting portions of the opposite surface of said recording element with an electrode in an imagewise pattern while maintaining an electric field strength of at least about $1\times10^5$ volts/cm between said electrode and said conductive member.

3. The process of claim 1 wherein said recording element is heated to a temperature in a range of about 80° C. to about 250° C.

4. The process of claim 1 wherein said recording element is heated to a temperature in a range of about 100° C. to about 160° C.

5. The process of claim 4 wherein the time of heating said recording element ranges from about 0.1 second to about 120 seconds.

6. The process of claim 4 wherein said heating step is performed while said recording element is in face to face contact with an element containing a reducing agent for said metal salt.

7. The process of claim 4 wherein said recording element contains at least one reducible metal salt of an organic fatty acid and a reducing agent therefor.

8. The process according to claim 7 wherein said metal salt is selected from the group consisting of salts of silver, lead, nickel and copper.

9. The process according to claim 7 wherein said metal salt is a silver salt of an organic acid.

10. The process according to claim 9 wherein said silver salt is selected from the group consisting of silver behenate, silver stearate, silver oleate, silver hydroxystearate, silver laurate, silver palmitate, silver caprate and silver myristate.

11. A dry electrographic recording process for producing a visible image in a charge-sensitive recording layer element having an ohmic resistivity of at least about $1\times10^{10}$ ohm-cm and containing at least one reducible metal salt in a binder, said process comprising the steps of:

(a) applying an electric potential having a field strength of at least about $1\times10^5$ volts/cm to selected portions of said recording element for a sufficient period of time to produce in said portions a storable latent image; and (b) heating the entire recording element substantially uniformly in the presence of a reducing agent until a sufficient quantity of said metal salt is reduced in said portions to form a visible image.

12. A dry electrographic recording process comprising the steps of:

(a) imagewise altering the conductivity of a photoconductive layer in accordance with a pattern which is to be recorded;

(b) positioning the imagewise altered photoconductive layer adjacent a charge-sensitive recording layer having an ohmic resistivity of at least about $1\times10$ ohm-cm and containing at least one reducible metal salt;

(c) applying an electric potential across said photoconductive and recording layers of a magnitude and for a sufficient period of time to produce in the areas of said recording layer corresponding to the imagewise altered portions of said photoconductive layer a charge density of from approximately 1 microcoulomb/cm$^2$ to approximately 1 millicoulomb/cm$^2$, such charge density forming in said areas a developable pattern of latent image sites; and (d) heating the entire recording element substantially uniformly in the presence of a reducing agent until a sufficient quantity of said metal salt is reduced at said image sites to form a visible image.

13. The process of claim 12 further including the steps of:

(a) subsequently positioning the imagewise altered photoconductive layer adjacent a second charge-sensitive recording layer having an ohmic resistivity of at least about $1\times10^{10}$ ohm-cm and containing at least one reducible metal salt;

(b) applying an electrical potential across said photoconductive and said second charge-sensitive recording layers of a magnitude and for a sufficient period of time to produce in the areas of said recording layer corresponding to the imagewise altered portions of said photoconductive layer a charge density of from approximately 1 microcoulomb/cm$^2$ to approximately 1 millicoulomb/cm$^2$, said charge density forming in said areas a developable pattern of latent image sites; and (c) uniformly heating the entire second charge-sensitive recording layer in the presence of a reducing agent until a sufficient quantity of said metal salt is reduced at said image sites to form a visible image.

14. A dry electrographic recording process for producing a visible image in a charge-sensitive recording element having an ohmic resistivity of at least about $1\times10^{10}$ ohm-cm and containing at least one reducible metal salt and a reducing agent therefor in a binder, said process comprising the steps of:

(a) positioning and recording element in face to face contact with a photoconductive element;

(b) exposing said photoconductive element to an imagewise pattern of actinic radiation while simultaneously applying across said photoconductive and recording elements an electric potential of a magnitude and for a sufficient period of time to produce in the areas of said recording element corresponding to the exposed areas of said photoconductive element a charge density of from approximately 1 microcoulomb/cm$^2$ to approximately 1 millicoulomb/cm$^2$, said charge density forming a developable pattern of latent image sites; and (c) heating the entire recording element substantially uniformly until a sufficient quantity of said metal salt is reduced at said image sites to form a visible image.

15. The process of claim 14 wherein the impedance of said recording element differs from the impedance of said photoconductive element by no more than approximately $10^5$ ohms-cm when said latent image forming electric potential is applied across said photoconductive and recording elements.

16. The process of claim 14 wherein said latent image forming electric potential produces a field strength of at least $1\times10^5$ volts/cm in the areas of said recording element corresponding to the exposed areas of said photoconductive element.

17. The process of claim 14 wherein said recording element is heated to a temperature of about 100° C. to about 160° C. for a time period of about 0.1 second to about 120 seconds.

18. The process according to claim 14 wherein said photoconductive element is x-ray sensitive and the conductivity of such element is imagewise altered by exposing said photoconductive element to x-ray radiation in accordance with the pattern to be recorded.

19. The process of claim 18 wherein said photoconductive element comprises a dispersion of lead oxide in an insulating binder coated on an electrically conducted, x-ray transparent support.

20. A dry electrographic recording process comprising the steps of:

(a) forming a conductivity pattern on a dielectric material;

(b) sequentially positioning said dielectric material containing said conductivity pattern in face to face contact with a plurality of charge-sensitive recording materials having an ohmic resistivity of at least $1\times10^{10}$ ohm-cm and containing at least one reducible metal salt in a binder and establishing a potential difference across said dielectric and recording materials of a magnitude and for a sufficient period of time to produce a charge density of from approximately 1 microcoulomb/cm$^2$ to approximately 1 millicoulomb/cm$^2$ in the area of each recording material corresponding to said conductivity pattern, said charge density being sufficient to form a latent image in said recording material; and (c) heating the recording materials substantially uniformly in the presence of a reducing agent for said metal salt to render the latent images visible.

21. A dry electrographic recording process for producing a visible image in a charge-sensitive recording element having an ohmic resistivity of at least $1\times10^{10}$ ohm-cm and containing at least one reducible metal salt and a reducing agent therefor in a binder, said process comprising the steps of:

(a) positioning said recording element on an electrically conducting backing member;

(b) modulating a corona ion current flow to the recording element by an electrostatic field established imagewise between an image grid comprising an electrically conductive core sequentially connectable to sources of different potential relative to said backing member and completely covered with a coating of a photoconductive insulating material and a control grid that is electrically conductive and sequentially connectable to sources of different potential relative to said backing member, said current flow being of a magnitude sufficient to produce a charge density of approximately from 1 microcoulomb/cm$^2$ to approximately 1 millicoulomb/cm$^2$ in selected portions of said recording element which charge density forms a latent image therein; and (c) heating the recording element substantially uniformly to render the latent image visible.

22. A dry electrographic process for recording and updating information on a charge-sensitive, heat developable recording element having an ohmic resistivity of at least $1\times10^{10}$ ohm-cm and containing at least one reducible metal salt and a reducing agent therefor in a binder, said process comprising the steps of:

(a) producing an electric current in selective portions of the recording element sufficient to produce therein a charge density of from approximately 1 microcoulomb/cm$^2$ to approximately 1 millicoulomb/cm$^2$ which charge density forms a first latent image therein;

(b) heating the entire recording element substantially uniformly to produce a visible image corresponding to said first latent image;

(c) subsequently producing an electric current in additional selective portions of the recording element sufficient to produce therein a charge density of from approximately 1 microcoulomb/cm$^2$ to approximately 1 millicoulomb/cm$^2$ which charge density forms a second latent image therein; and (d) uniformly heating the entire recording element to produce a visible image corresponding to said second latent image.

23. A dry electrographic process for recording and updating information on a charge and light sensitive, heat developable recording element having an ohmic resistivity of at least $1\times10^{10}$ ohm-cm and containing at least one reducible metal salt and a reducing agent therefor in a binder, said process comprising the steps of:

(a) exposing said recording element to an imagewise pattern of light to form therein a first latent image;

(b) heating said recording element substantially uniformly to produce a visible image corresponding to said first latent image;

(c) subsequently producing an electric current in selected portions of said recording element to produce therein a charge density of from approximately 1 microcouloumb/cm$^2$ to approximately 1 millicouloumb/cm$^2$ which charge density forms a second latent image; and (d) heating said entire recording elements substantially uniformly to produce a visible image corresponding to said second latent image.

24. A dry electrographic process for recording and updating information on a charge and light sensitive, heat developable recording element having an ohmic resistivity of at least $1\times10^{10}$ ohm-cm and containing at least one reducible metal salt and a reducing agent therefor and a binder, said process comprising the steps of:

(a) producing an electric current in selected portions of said recording element sufficient to produce therein a charge density of from approximately 1 microcoulomb/cm$^2$ to approximately 1 millicoulomb/cm$^2$ which charge density forms a first latent image;

(b) heating said recording element substantially uniformly to produce a visible image corresponding to said first latent image;

(c) subsequently exposing said recording element to an imagewise pattern of light to form therein a second latent image; and (d) heating said recording element substantially uniformly to produce a visible image corresponding to said second latent image.

25. A dry electrographic recording process for producing a visible image in a charge-sensitive recording element having an ohmic resistivity of from about $1\times10^{10}$ ohm-cm to about $1\times10^{15}$ ohm-cm and comprising an electrically conductive support having thereon an emulsion comprising at least one reducible metal salt and a reducing agent therefor in a polymeric binder, said process comprising the steps of:

(a) contacting portions of the emulsion surface of said recording element with an electrode while a potential difference of at least 3 kilovolts is maintained between said electrode and said conductive support, said potential difference being maintained until a charge density of approximately 1 microcoulomb/cm$^2$ is achieved in the contacted portions of said recording element which charge density forms an imagewise pattern of developable latent image sites; and (b) heating said recording element substantially uniformly until a sufficient quantity of said metal salt is reduced at said image sites to form a visible image.

26. A dry electrographic recording process for producing a visible image in a charge-sensitive recording element having an ohmic resistivity of from about $1\times10^{10}$ ohm-cm to about $1\times10^{15}$ ohm-cm and comprising an electrically conductive support having thereon an emulsion comprising at least one reducible metal salt and a reducing agent therefor in a polymeric binder said process comprising the steps of:

(a) placing the emulsion surface of said recording element in face to face contact with a photoconductive element;

(b) exposing said photoconductive element to an imagewise pattern of actinic radiation while simultaneously maintaining a potential having an electric field strength of approximately $1\times10^5$ volts/cm between said photoconductive element and said conductive support, said potential difference being of a magnitude sufficient to produce in the areas of said recording element corresponding to the exposed areas of said photoconductive element a charge density of approximately 1 microcouloumb/cm$^2$ which charge density forms an imagewise pattern of developable latent image sites; and (c) heating said recording elements substantially uniformly until a sufficient quantity of said metal salt is reduced at said image sites to form a latent image.

* * * * *